US006031441A

United States Patent [19]

Yen

[11] Patent Number: 6,031,441

[45] Date of Patent: Feb. 29, 2000

[54] BALLAST STABILIZER AND ITS FABRICATION METHOD

[76] Inventor: Kan-Lin Yen, No. 9, Sec. 2, Chung-Shiaw E. Rd., Taipei, Taiwan

[21] Appl. No.: 09/131,327

[22] Filed: Aug. 7, 1998

[51] Int. Cl.[7] ..... H01F 27/02

[52] U.S. Cl. ..... 336/96; 29/606; 29/609; 336/178; 336/212; 336/216

[58] Field of Search ..... 336/165, 212, 336/178, 198, 65, 96, 216, 210, 219; 29/602.1, 606, 607, 609

[56] References Cited

U.S. PATENT DOCUMENTS 4,146,857 3/1979 Schleupen ..... 336/178

5,117,215 5/1992 Kakehashi et al. ..... 336/178

*Primary Examiner*—Thomas J. Kozma

*Attorney, Agent, or Firm*—Bacon & Thomas, PLLC

[57] ABSTRACT

A ballast stabilizer includes a stack of annular silicon steel plates defining a center through hole, a perforated bottom-open casing mounted within the center through hole of the stack of annular silicon steel plates, a winding holder mounted within the casing, the winding holder having a center open chamber, a peripheral wire groove, and a winding mounted in the peripheral wire groove around the winding holder, a stack of I-shaped silicon steel plates received in the open chamber of the winding holder, and a varnish coating covered over the stack of annular silicon steel plates and filled up the gaps in the casing, the winding holder and the stack of I-shaped silicon steel plates.

4 Claims, 6 Drawing Sheets

BALLAST STABILIZER AND ITS FABRICATION METHOD

BACKGROUND OF THE INVENTION

The present invention relates to a ballast stabilizer, and more particularly to such a ballast stabilizer which is water proof and dust proof and, which provides a stabilized path. The invention relates also to a method of fabricating such a ballast stabilizer.

In order to have the magnetic path of a ballast stabilizer be evenly distributed around the winding, the iron core may be arranged in the shape of the Chinese character 田, permitting the winding to be mounted around the center area. Further, in order to saturation of the magnetic path, air gaps may be provided at the silicon steel plates. FIG. 1 shows a ballast stabilizer according to the prior art, in which E-shaped silicon steel plates 51 and I-shaped silicon steel plates 52 are fastened together to hold a winding on the inside. The E-shaped silicon steel plates 51 each have a short middle support 511. When the E-shaped silicon steel plates 51 and I-shaped silicon steel plates 52 are fastened together, an air gap 53 exists between the short middle supports 511 and the I-shaped silicon steel plates 52 to stabilize the magnetic path. However, because the width of the air gap 53 is controlled by means of the depth in which the I-shaped silicon steel plates 52 are inserted, it is difficult to accurate control the width of the air gap 53 during the fabrication process. FIG. 2 shows another structure of ballast stabilizer according to the prior art, in which U-shaped silicon steel plates 54 and T-shaped silicon steel plates 55 are fastened together to hold a winding on the inside. When assembled, an air gap 56 is provided between the end of the T-shaped silicon steel plates 55 and the inside wall of the U-shaped silicon steel plates 54. This structure of ballast stabilizer cannot eliminate the aforesaid problem. FIGS. 3A and 3B show still another structure of ballast stabilizer according to the prior art. According to this structure of ballast stabilizer, a soft metal rod 57 is inserted in between the middle support 511 of the stack of E-shaped silicon steel plates 51 and the stack of I-shaped silicon steel plates 52, then the stack of E-shaped silicon steel plates 51 and the stack of I-shaped silicon steel plates 52 are compressed against each other, causing the soft metal rod 57 to be flattened, and therefore a gap is obtained between the middle support 511 of the stack of E-shaped silicon steel plates 51 and the stack of I-shaped silicon steel plates 52 to stabilize the magnetic path. This structure of ballast stabilizer is still not satisfactory in function. One drawback of this structure of ballast stabilizer is its poor insulative and water proof arrangement. Another drawback of this structure of ballast stabilizer is its complicated processing procedure and high manufacturing cost.

SUMMARY OF THE INVENTION

It is one object of the present invention to provide a ballast stabilizer which is easy and inexpensive to manufacture. It is another object of the present invention to provide a ballast stabilizer which is water proof and dust proof. It is still another object of the present invention to provide a ballast stabilizer which provides a stabilized the magnetic path. To achieve these and other objects of the present invention, there is provided a ballast stabilizer comprised of a stack of annular silicon steel plates defining a center through hole, a perforated bottom-open casing mounted within the center through hole of the stack of annular silicon steel plates, a winding holder mounted within the casing, the winding holder having a center open chamber, a peripheral wire groove, and a winding mounted in the peripheral wire groove around the winding holder, a stack of I-shaped silicon steel plates received in the open chamber of the winding holder, and a varnish coating covered over the stack of annular silicon steel plates and filled up the gaps in the casing, the winding holder and the stack of I-shaped silicon steel plates.

BRIEF DESCRIPTION OF THE DRAWINGS

FIG. I illustrates a ballast stabilizer according to the prior art.

DETAILED DESCRIPTION OF THE PREFERRED EMBODIMENT

Figure 2:
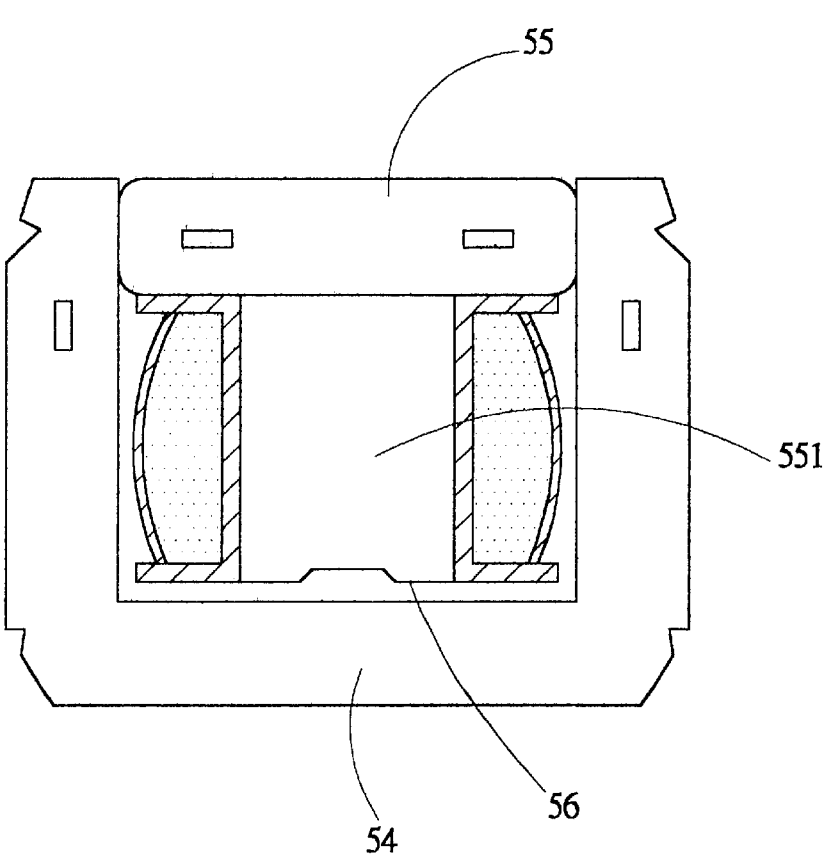
FIG. 2 illustrates another structure of ballast stabilizer according to the prior art.
Figure 1:
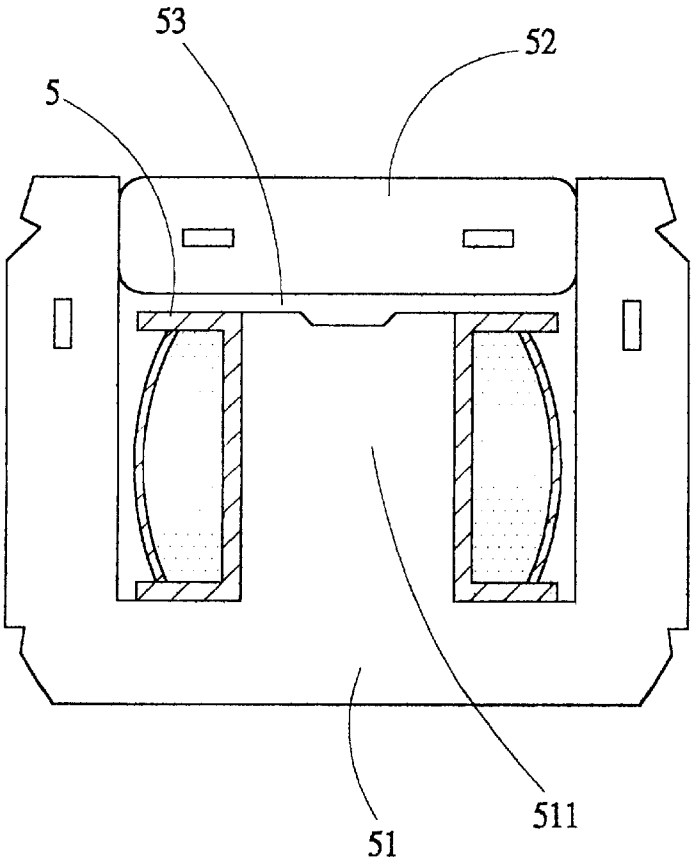
Fig. 1 Prior Art
Figure 3B:
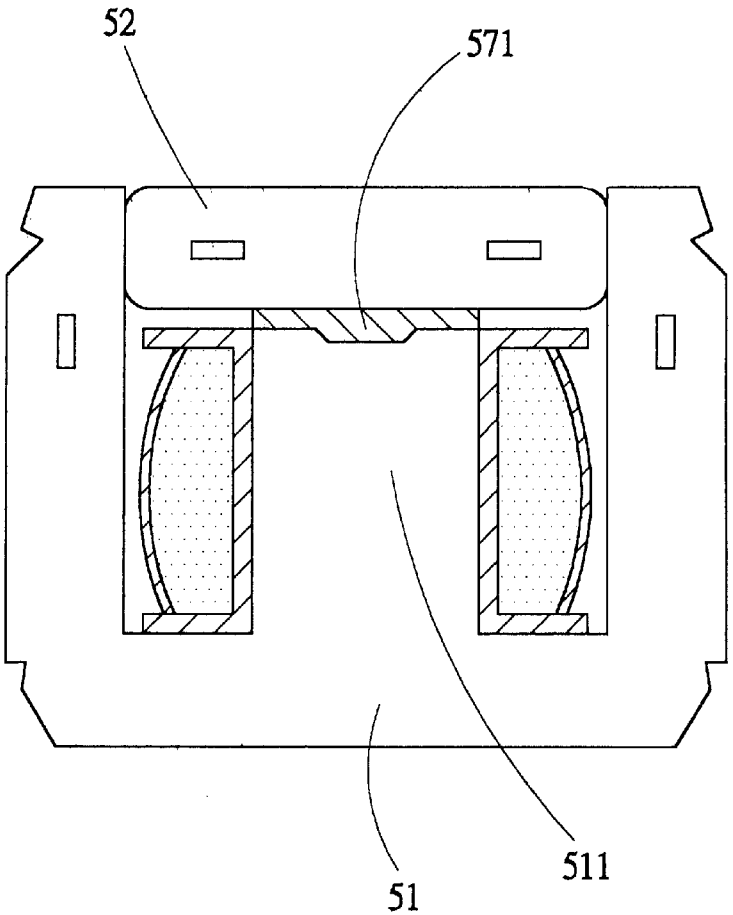
FIG. 3A and 3B illustrate still another structure of ballast stabilizer according to the prior art.
Figure 3A:
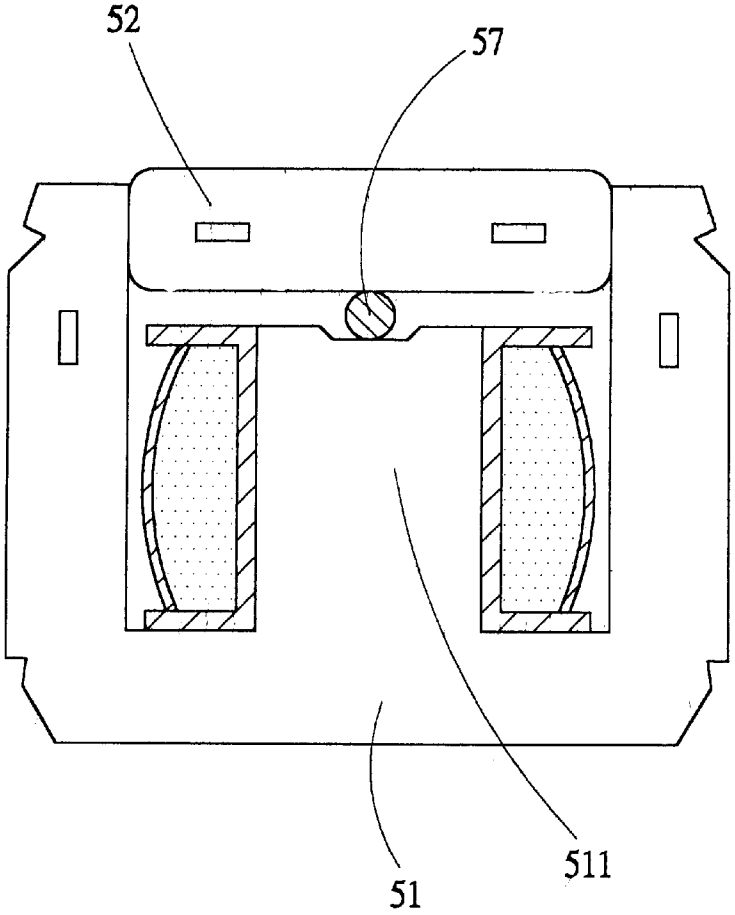
Fig. 3 A Prior Art
Figure 4:
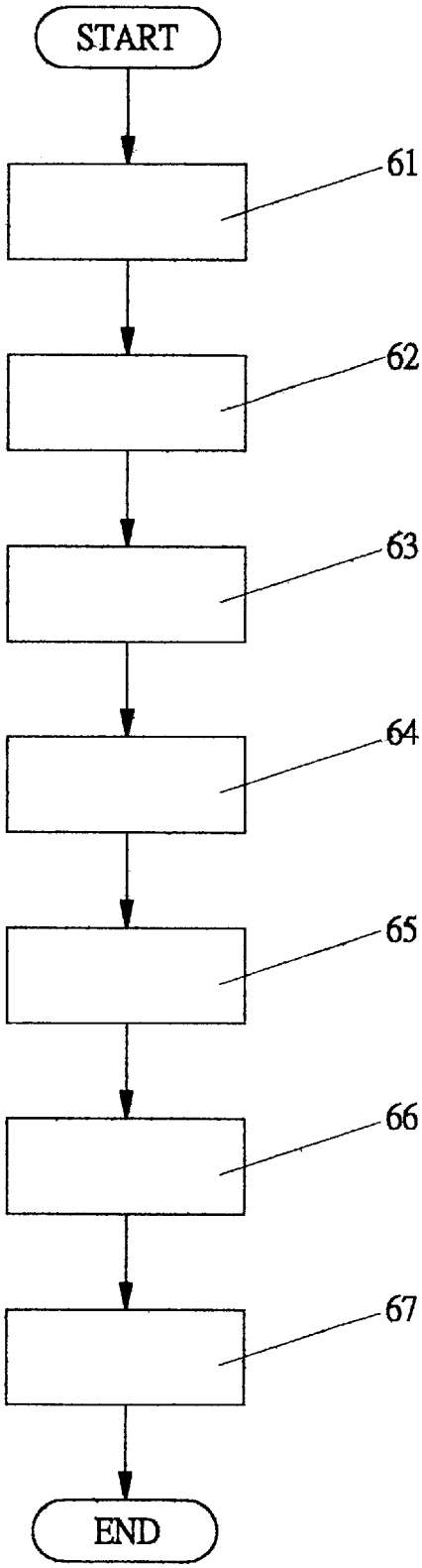
FIG. 4 is a ballast stabilizer production block diagram according to the present invention.

Referring to FIG. 4, a ballast stabilizer fabrication method in accordance with the present invention comprises step 61 of preparing a winding holder having a center open chamber and a winding groove around the periphery and then winding an enabled wire around the wire groove of the winding holder, step 62 of putting a stack of I-shaped silicon steel plates having a bottom locating groove in the center open chamber of the winding holder, step 63 of putting the winding holder with the stack of I-shaped silicon steel plates in a perforated casing having beveled peripheral guide edge at one end, step 64 of preparing a stack of annular silicon steel plates having a center through hole and an inside flange inside the center through hole and then inserting the beveled peripheral guide edge of the perforated casing into the center through hole of the stack of annular silicon steel plates, step 65 of forcing the perforated casing into the inside of the center through hole of the stack of annular silicon steel plates, causing the locating groove of the stack of I-shaped silicon steel plates to be forced into engagement with the inside flange of the stack of annular silicon steel plates and permitting the top side of the stack of I-shaped silicon steel plates to be isolated from the inside wall of the stack of annular silicon steel plates, step 66 of dipping the assembly of the stack of annular silicon steel plates, the casing, the winding holder and the stack of I-shaped silicon steel plates in varnish, step 67 of picking up the assembly of the stack of annular silicon steel plates, the casing, the winding holder and the stack of I-shaped silicon steel plates from varnish and then drying the assembly into a finished ballast stabilizer.

Figure 5:
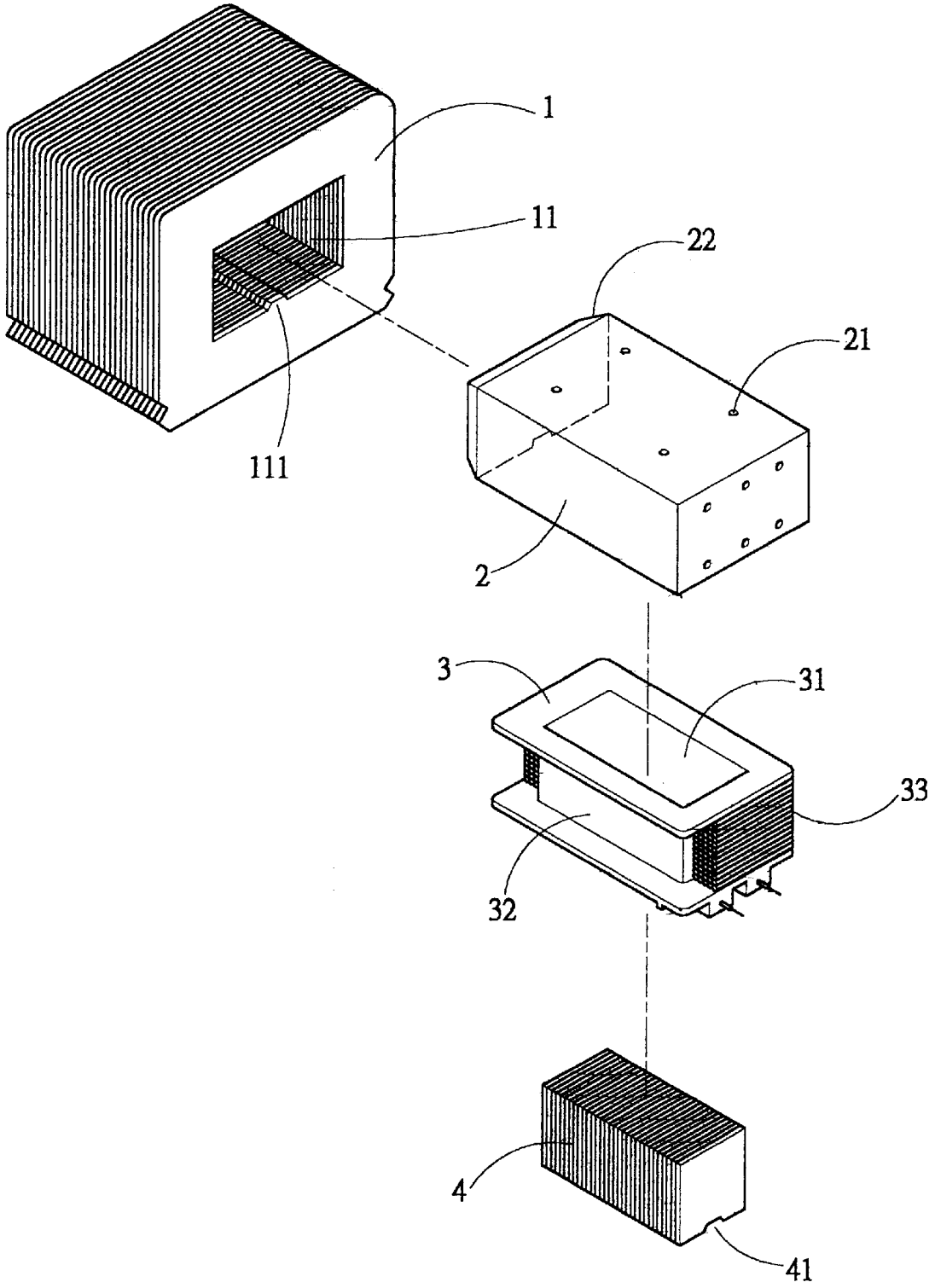
FIG. 5 is an exploded view of a ballast stabilizer according to the present invention.

Referring to FIG. 5, a ballast stabilizer made according to the aforesaid fabrication method is generally comprised of a stack of annular silicon steel plates 1, a casing 2, a winding holder 3, and a stack of I-shaped silicon steel plates 4.

The stack of annular silicon steel plates 1 defines a center through hole 11, and has a flange 111 axially disposed in the center through hole 11 at one side. The casing 2 is a bottom-open container having a beveled peripheral guide edge 22 at one end, and a plurality of through holes 21. The winding holder 3 comprises an open chamber 31 on the middle, a wire groove 32 around the periphery, and a winding 33 wound round the wire groove 32. The stack of I-shaped silicon steel plates 4 is mounted in the open chamber 31 inside the winding holder 3, having a locating groove 41 longitudinally disposed at one side.

Figure 6:
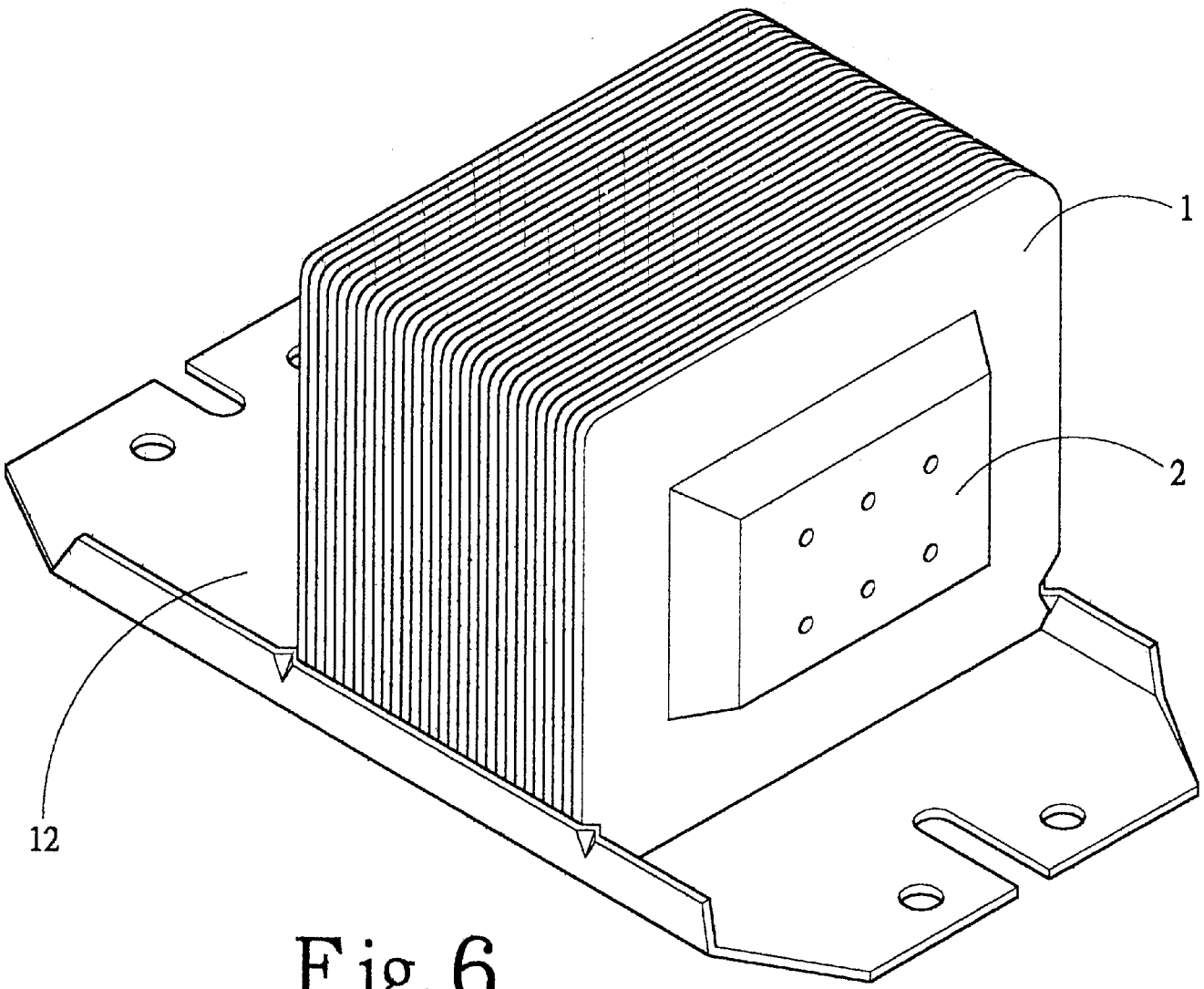
FIG. 6 shows the ballast stabilizer fastened to a mounting plate according to the present invention.
Figure 7:
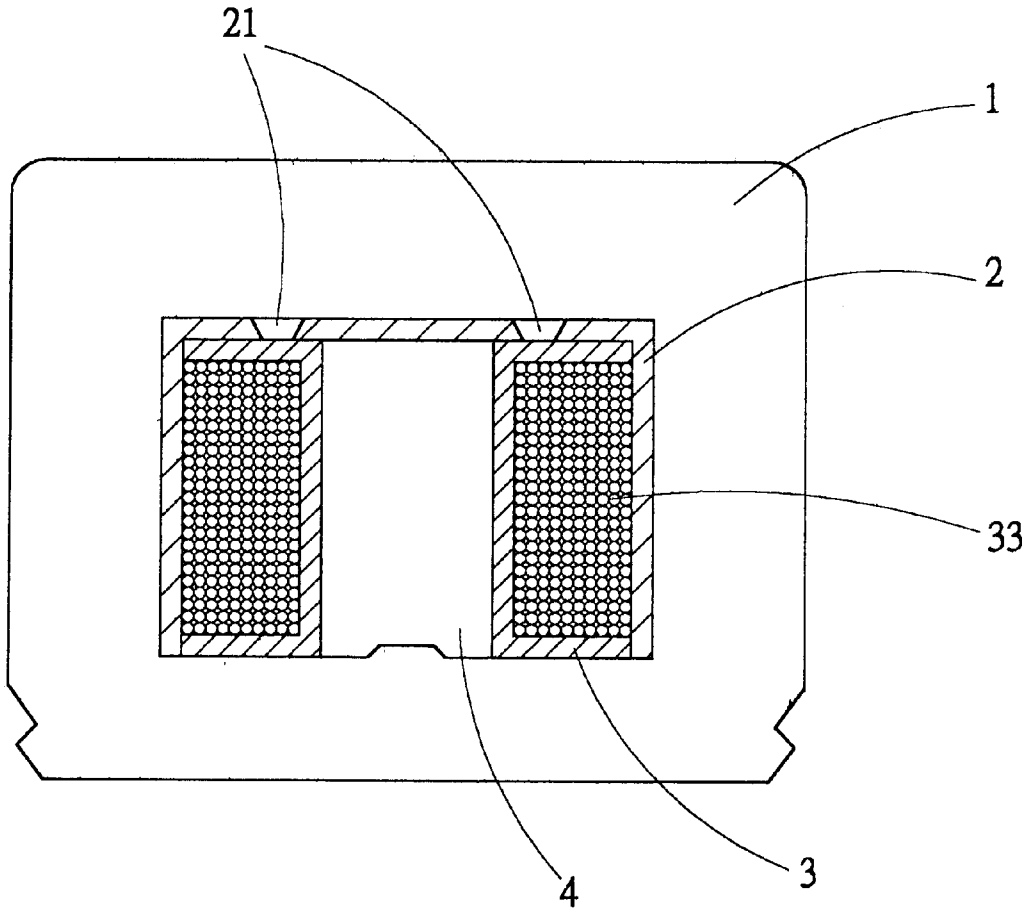
FIG. 7 is a sectional assembly view of the ballast stabilizer shown in FIG. 5.

Referring to FIGS. 6 and 7, the stack of I-shaped silicon steel plates 4 is put in the open chamber 31 within the winding holder 3, then the winding holder 3 is put in the casing 2, and then the casing 2 is inserted into the center through hole 11 of the stack of annular silicon steel plates 1, permitting the locating groove 41 of the stack of I-shaped silicon steel plates 4 to be forced into engagement with the flange 111 inside the center through hole 11 of the stack of annular silicon steel plates 1. By means of the beveled peripheral guide edge 22, the casing 2 can be conveniently inserted into the center through hole 11 of the stack of annular silicon steel plates 1 and set into position. When assembled, the assembly is dipped in varnish, permitting varnish to penetrate through the through holes 21 on the casing 2 and to fill up the gaps in the winding holder 3 and the stack of I-shaped silicon steel plates 4. When varnish is hardened, the whole assembly of the ballast stabilizer becomes water proof and dust proof. When the ballast stabilizer is assembled, a mounting plate 12 is fastened to the assembly of the ballast stabilizer at the bottom side of the stack of annular silicon steel plates 1. Because the flange 111 of the stack of annular silicon steel plates 1 is engaged into the locating groove 41 at one side namely the bottom side of the I-shaped silicon steel plates 4, and the opposite side namely the top side of the I-shaped silicon steel plates 4 is spaced from the inside wall of the stack of annular silicon steel plates 1 by the casing 2, an air gap exists between the stack of annular silicon steel plates I and the stack of I-shaped silicon steel plates 4 to stabilize the magnetic path.

As indicated above, the present invention provides a ballast stabilizer in which a fixed air gap exists in between the stack of annular silicon steel plates 1 and the stack of I-shaped silicon steel plates 4 to stabilize the magnetic path, varnish is covered over the whole assembly of the ballast stabilizer and filled up the gaps therein to protect the whole assembly of the ballast stabilizer against water and dust.

It is to be understood that the drawings are designed for purposes of illustration only, and are not intended as a definition of the limits and scope of the invention disclosed.

What the invention claimed is:

1. A ballast stabilizer fabrication method comprising the steps of:

A. preparing a winding holder having a center open chamber and a winding groove around the periphery and then winding an enabled wire around the wire groove of said winding holder;

B. putting a stack of I-shaped silicon steel plates having a bottom locating groove in the center open chamber of said winding holder;

C. putting the assembly of said winding holder and said stack of I-shaped silicon steel plates in a perforated casing having beveled peripheral guide edge at one end;

D. preparing a stack of annular silicon steel plates having a center through hole and an inside flange inside the center through hole and then inserting the beveled peripheral guide edge of said perforated casing into the center through hole of said stack of annular silicon steel plates;

E. forcing said perforated casing into the inside of the center through hole of said stack of annular silicon steel plates, causing the locating groove of said stack of I-shaped silicon steel plates to be forced into engagement with the inside flange of said stack of annular silicon steel plates and permitting a top side of said stack of I-shaped silicon steel plates to be isolated from an inside wall of said stack of annular silicon steel plates;

F. dipping the assembly of said stack of annular silicon steel plates said perforated casing, said winding holder and said stack of I-shaped silicon steel plates in varnish;

G. picking up the assembly of said stack of annular silicon steel plates, said perforated casing, said winding holder and said stack of I-shaped silicon steel plates from varnish, and then drying the assembly into a finished ballast stabilizer.

2. A ballast stabilizer comprising:

a stack of I-shaped silicon steel plates;

a winding holder, said winding holder comprising an open chamber on the middle, which receives staid stack of I-shaped silicon steel plates, a wire groove around the periphery, and a winding wound round said wire groove;

a stack of annular silicon steel plates, said stack of annular silicon steel plates having a center through hole; and a casing mounted in the center through hole of said stack of annular silicon steel plates to hold said winding holder and said stack of I-shaped silicon steel plates on the inside, said casing comprising a bottom opening through which said winding holder and said stack of annular silicon steel plates are inserted into the inside of said casing, and a beveled peripheral guide edge at one end for guiding said casing into the center through hole on said stack of annular silicon steel plates.

3. The ballast stabilizer of claim 2 wherein said stack of annular silicon steel plates has an inside flange inside the center through hole thereof, and said stack of I-shaped silicon steel plates has a locating groove at a bottom side thereof engaged with the inside flange of said stack of annular silicon steel plates.

4. The ballast stabilizer of claim 2 wherein said casing has a plurality of through holes at the periphery through which varnish is applied to the inside of said casing and gaps in said winding holder and said stack of I-shaped silicon steel plates.

* * * * *